US007815341B2

(12) United States Patent
Steedly et al.

(10) Patent No.: US 7,815,341 B2
(45) Date of Patent: Oct. 19, 2010

(54) STRIP ILLUMINATION DEVICE

(75) Inventors: James Steedly, Huntington Breach, CA (US); Fernando Lynch, Orange, CA (US); Chris Werner, Irvine, CA (US)

(73) Assignee: Permlight Products, Inc., Tustin, CA (US)

( * ) Notice: Subject to any disclaimer, the term of this patent is extended or adjusted under 35 U.S.C. 154(b) by 0 days.

(21) Appl. No.: 11/950,364

(22) Filed: Dec. 4, 2007

(65) Prior Publication Data

US 2008/0192462 A1 Aug. 14, 2008

Related U.S. Application Data

(60) Provisional application No. 60/901,138, filed on Feb. 14, 2007.

(51) Int. Cl.
*F21V 29/00* (2006.01)

(52) U.S. Cl. ..... 362/294; 362/218; 362/217.01; 362/240; 362/800; 362/227

(58) Field of Classification Search ..... 362/218, 362/217, 240, 800, 227
See application file for complete search history.

(56) References Cited

U.S. PATENT DOCUMENTS

| | | | |
|---|---|---|---|
| 3,500,036 | A | 3/1970 | Szentveri |
| 4,908,743 | A | 3/1990 | Miller |
| D311,588 | S | 10/1990 | Nagano |
| 5,107,408 | A | 4/1992 | Vernondier |
| 5,321,593 | A | 6/1994 | Moates |
| 5,343,375 | A | 8/1994 | Gross et al. |
| 5,499,170 | A | 3/1996 | Gagne |
| 5,607,227 | A | 3/1997 | Yasumoto et al. |
| 5,746,497 | A | 5/1998 | Machida |
| 5,785,411 | A | 7/1998 | Komai et al. |
| 5,857,767 | A | 1/1999 | Hochstein |
| 5,927,845 | A | 7/1999 | Gustafson |
| 5,958,572 | A | 9/1999 | Schmidt et al. |
| 6,017,241 | A | 1/2000 | Komai |

(Continued)

FOREIGN PATENT DOCUMENTS

DE 29803105 U1 9/1998

(Continued)

OTHER PUBLICATIONS

*Thermal Solutions for Long-Term Reliability of Power LEDs, Thermal Management for LED Applications Solutions Guide*, The Bergquist Company, Chanhassen, Minnesota, 6 pages.

(Continued)

*Primary Examiner*—Sandra L O'Shea
*Assistant Examiner*—Jessica L McMillan
(74) *Attorney, Agent, or Firm*—Knobbe, Martens, Olson & Bear, LLP.

(57) ABSTRACT

A low-profile strip illumination device comprises a substrate supporting an elongate heat conductor and positively and negatively energized elongate rails. A plurality of spaced apart light emitting diodes (LEDs) are mounted so as to be powered by the elongate rails. The LEDs are arranged generally adjacent the elongate heat conductor so that a heat flow path is defined from each LED to the elongate heat conductor and to the environment.

18 Claims, 8 Drawing Sheets

U.S. PATENT DOCUMENTS

| | | | | |
|---|---|---|---|---|
| 6,045,240 | A | 4/2000 | Hochstein | |
| 6,074,074 | A | 6/2000 | Marcus | |
| 6,113,248 | A | 9/2000 | Mistopoulos | |
| 6,220,724 | B1 | 4/2001 | Krokeide | |
| 6,249,267 | B1 | 6/2001 | Ishihara | |
| 6,283,612 | B1 | 9/2001 | Hunter | |
| 6,356,448 | B1 | 3/2002 | DiBene, II et al. | |
| 6,371,637 | B1 | 4/2002 | Atchinson et al. | |
| 6,394,626 | B1 | 5/2002 | McColloch | |
| 6,416,200 | B1 | 7/2002 | George | |
| 6,428,189 | B1 | 8/2002 | Hochstein | |
| 6,455,930 | B1 | 9/2002 | Palanisamy et al. | |
| 6,460,598 | B1 | 10/2002 | Adams et al. | |
| 6,478,450 | B1 | 11/2002 | Grajcar | |
| 6,481,874 | B2 | 11/2002 | Petroski | |
| 6,502,968 | B1 | 1/2003 | Simon | |
| 6,505,956 | B1 | 1/2003 | Priddy et al. | |
| 6,518,502 | B2 | 2/2003 | Hammond et al. | |
| 6,578,986 | B2 | 6/2003 | Swaris et al. | |
| 6,582,100 | B1 | 6/2003 | Hochstein et al. | |
| 6,582,103 | B1 | 6/2003 | Popovich et al. | |
| 6,619,831 | B2 | 9/2003 | Kanesaka | |
| 6,659,622 | B2 | 12/2003 | Katogi et al. | |
| 6,659,623 | B2 | 12/2003 | Friend | |
| 6,660,935 | B2 | 12/2003 | Southard et al. | |
| 6,712,486 | B1 | 3/2004 | Popovich et al. | |
| 6,720,859 | B2 | 4/2004 | Mazzochette | |
| 6,758,573 | B1 | 7/2004 | Thomas et al. | |
| 6,793,369 | B2 | 9/2004 | Calzaretta | |
| 6,846,093 | B2 | 1/2005 | Swaris et al. | |
| 6,871,983 | B2 | 3/2005 | Jacob et al. | |
| 6,880,952 | B2 | 4/2005 | Kiraly et al. | |
| 7,102,172 | B2 | 9/2006 | Lynch et al. | |
| 7,108,396 | B2 | 9/2006 | Swaris et al. | |
| 7,114,831 | B2 | 10/2006 | Popovich et al. | |
| 7,165,863 | B1 | 1/2007 | Thomas et al. | |
| 7,187,010 | B2 | 3/2007 | Tsukagoshi | |
| 7,213,940 | B1 | 5/2007 | Van de Ven et al. | |
| 7,252,408 | B2 | 8/2007 | Mazzochette | |
| 7,306,353 | B2 | 12/2007 | Popovich | |
| 7,329,024 | B2 | 2/2008 | Lynch et al. | |
| 7,329,042 | B2 * | 2/2008 | Hiranuma et al. | 368/308 |
| 7,387,406 | B2 | 6/2008 | Swaris et al. | |
| 7,513,639 | B2 * | 4/2009 | Wang | 362/218 |
| 2003/0063463 | A1 * | 4/2003 | Sloan et al. | 362/238 |
| 2003/0112627 | A1 | 6/2003 | Deese | |
| 2003/0174517 | A1 | 9/2003 | Kiraly et al. | |
| 2003/0184998 | A1 | 10/2003 | Collins | |
| 2003/0218417 | A1 | 11/2003 | Chin | |
| 2003/0223235 | A1 | 12/2003 | Mohacsi et al. | |
| 2003/0230934 | A1 | 12/2003 | Cordelli et al. | |
| 2005/0077525 | A1 | 4/2005 | Lynch et al. | |
| 2006/0221609 | A1 | 10/2006 | Ryan, Jr. | |
| 2007/0285949 | A1 * | 12/2007 | Lodhie et al. | 362/648 |
| 2008/0055915 | A1 | 3/2008 | Lynch et al. | |
| 2009/0086488 | A1 | 4/2009 | Lynch et al. | |

FOREIGN PATENT DOCUMENTS

| | | |
|---|---|---|
| EP | 0 331 224 | 9/1989 |
| EP | 1 479 286 | 11/2004 |
| WO | WO 00/36336 | 6/2002 |
| WO | WO 2004/021461 A2 | 3/2004 |

OTHER PUBLICATIONS

Samuelson, Rick, et al., *Power Systems Design Europe, Thermal Management Made Simple*, Dec. 2005, The Bergquist Company, Chanhassen, Minnesota, 6 pages.

SloanLED: ChanneLED3 LED Lighting Solutions for Channel Letters, © 2003 SloanLED, 2 pages.

LumiLeds Lighting Publication No. DS17, *LED Rail System Data Sheet*, HLCR-SS99-X1X00, 6 pages.

Petroski, James, *Thermal Challenges Facing New Generation LEDs for Lighting Applications*, in Solid State Lighting II, Proceedings of SPIE vol. 4776 (2002), 8 pages.

* cited by examiner

STRIP ILLUMINATION DEVICE

CROSS-REFERENCE TO RELATED APPLICATIONS

This application claims the benefit of U.S. Provisional Application No. 60/901,138, which was filed on Feb. 14, 2007, the entirety of which is hereby incorporated by reference.

BACKGROUND

1. Field of the Invention

The present invention is in the field of illumination devices and, more specifically, light emitting diode (LED)-based illumination devices.

2. Description of the Related Art

Strip-type illumination devices are particularly useful for lighting applications such as under-cabinet lighting and cove lighting. Such strip illumination devices are typically made up of a plurality of light sources spaced apart from one another along a length of an elongate substrate. Generally, it is desirable to hide such strip illumination devices from direct view. Thus, manufacturers try to design strip devices having a comparably low profile as compared to other luminaires. Also, due the their typical positioning, for example as under-cabinet lighting or cove lighting, strip luminaires may be difficult to install and service.

Strip illumination devices employing light emitting diodes (LEDs) have been developed in an effort to take advantage of the long life and small packaging of LEDs. However, such LED-based devices often are not conducive to customized installations, in which the length of a prefabricated strip may need to be adjusted during installation. Also, LEDs tend to decrease both in brightness and in expected lifetime if they operate in configurations in which the heat generated by the LED is not efficiently evacuated.

SUMMARY

Accordingly, there is a need in the art for a low-profile, LED-based strip illumination device that is easy to adapt to customized installations. There is also a need for an LED-based strip illumination device that efficiently directs heat away from the LED.

In accordance with one embodiment, the present invention provides an illumination apparatus, comprising an elongate substrate, first and second electrically conductive rails, and a plurality of LED modules. The first and second rails are supported by the substrate so that the first and second rails are spaced apart and electrically insulated from one another. Each LED module comprises a module body, an LED, and an electrical current path. The current path is configured so that electrical current flows from a first electrical contact to a second electrical contact. The LED is interposed in the current path between the first and second contacts so that electrical current flows along the path and through the LED. A plurality of fasteners are provided and are adapted to connect the plurality of LED modules to the elongate substrate so that the first and second contacts of each LED module are electrically connected to the first and second rails, respectively.

In accordance with one embodiment, a pair of fasteners are used to connect each LED module to the elongate substrate. In one such embodiment, a first one of each pair of fasteners is adapted to engage the first rail and the first contact so as to conduct current between the first rail and the first contact. In another embodiment, a second one of each pair of fasteners is adapted to engage the second rail and the second contact so as to conduct current between the second rail and the second contact.

In yet another such embodiment, the first fastener comprises a threaded fastener, the first rail comprises a threaded portion, and the first fastener threadingly engages the first rail threaded portion. In one such embodiment, the LED module comprises a dielectric layer having a dielectric thickness, the dielectric layer disposed on a first side of the LED module body, the first and second contacts disposed on the dielectric layer and having a contact thickness. A first aperture is formed through the body, dielectric layer and first contact, and the first aperture is configured to accommodate a shank portion of the first fastener extending therethrough. The first fastener has a head portion adapted to engage the first contact, and a ratio of a diameter of the head portion to the combined dielectric thickness and contact thickness is between about 80:1-125:1.

In another embodiment, the first and second rails are substantially embedded in the elongate substrate.

In yet another embodiment, a heat conductive insert is supported by the elongate substrate so that the LED module body generally directly contacts the insert. In one such embodiment, the heat conductive insert has an insert thickness, and the elongate substrate comprises a substrate cavity configured to generally accommodate the heat conductive insert, the substrate cavity having a cavity depth. The cavity depth is less than the insert thickness.

In still another embodiment, an elongate cavity is formed in the substrate, and the heat conductive insert is elongate and sits at least partially in the elongate cavity. In one such embodiment, each LED module body has opposing first and second sides, and the LED is disposed adjacent a mounting point on the first side of the body. The body is connected to the heat conductive insert so that the insert directly contacts the second side of the body directly opposite the mounting point.

In accordance with another embodiment, an illumination apparatus is provided. The apparatus comprises an elongate substrate, first and second electrically conductive rails, a heat sink supported by the substrate, and a plurality of pre-packaged LEDs. The first and second rails are supported by the substrate so that the first and second rails are spaced apart and electrically insulated from one another. The LEDs are electrically connected to the first and second rails so that an electric current path is established between the rails and across at least one of the LEDs, and the LEDs are mounted so that the associated LED package is substantially directly aligned with the heat sink.

In another embodiment, the LED package is vertically aligned with the heat sink. In one such embodiment, the heat sink is horizontally spaced from the rails. In another embodiment, the heat sink is vertically spaced from the rails.

In yet another embodiment, the LED package comprises a package heat sink, and the package heat sink is in substantially direct contact with the heat sink.

DETAILED DESCRIPTION OF PREFERRED EMBODIMENTS

Figure 1:
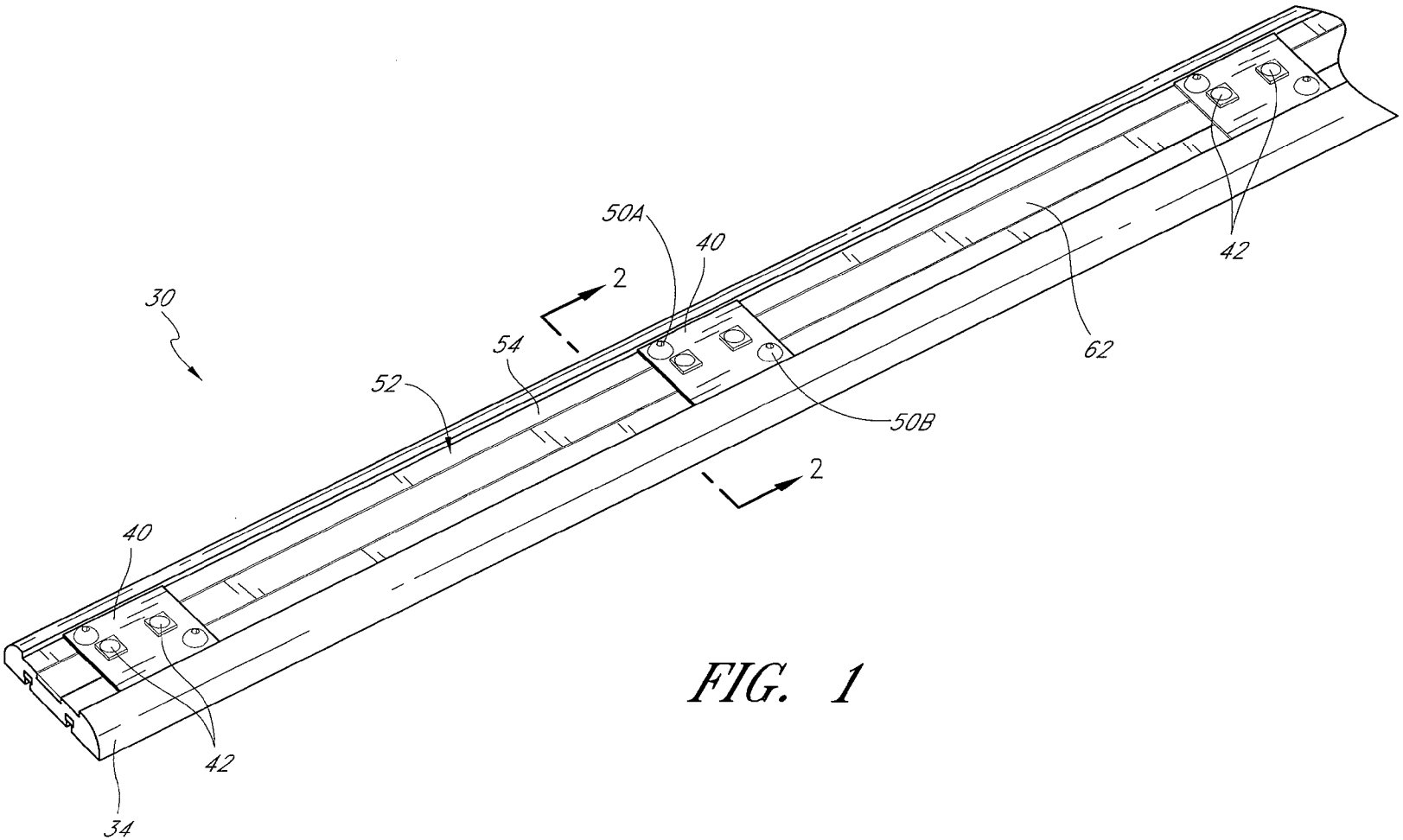
FIG. 1 is a perspective view of an embodiment.

With initial reference to FIGS. 1-6, an embodiment of a strip illumination device 30 is presented. Such a device comprises a light strip section 32 that can be used alone, trimmed to a desired size, and/or combined with other sections to create an illumination system.

In the illustrated embodiment the strip section 32 comprises an elongate substrate 34 upon which a plurality of light emitting diode (LED) modules 40 are mounted spaced apart from each other. Each LED module 40 comprises one or more LEDs 42 that provide light when energized. The illustrated embodiment includes modules 40 having two LEDs 42. Preferably, the LED modules 40 have an easily-mounted and thermally managed structure such as is disclosed in assignee's U.S. Pat. No. 7,114,831, the entirety of which is hereby incorporated by reference. For example, the LED module 40 preferably has a heat conductive body 44, such as an aluminum body, upon which an electric circuit 46 is disposed. Preferably, the circuit is electrically insulated from the body 44. LEDs 42 are arranged on the circuit 46. The circuit terminates at positive and negative contacts 48A, 48B at which positive and negative fasteners 50A, 50B (bolts in the illustrated embodiments) are attached to the module 40.

Figure 2:
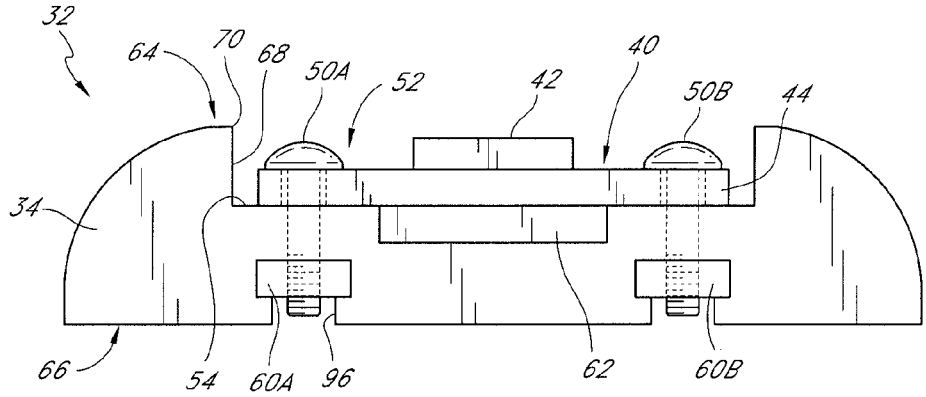
FIG. 2 is a cross-sectional view of the embodiment of FIG. 1 taken along line 2-2.
Figure 3:
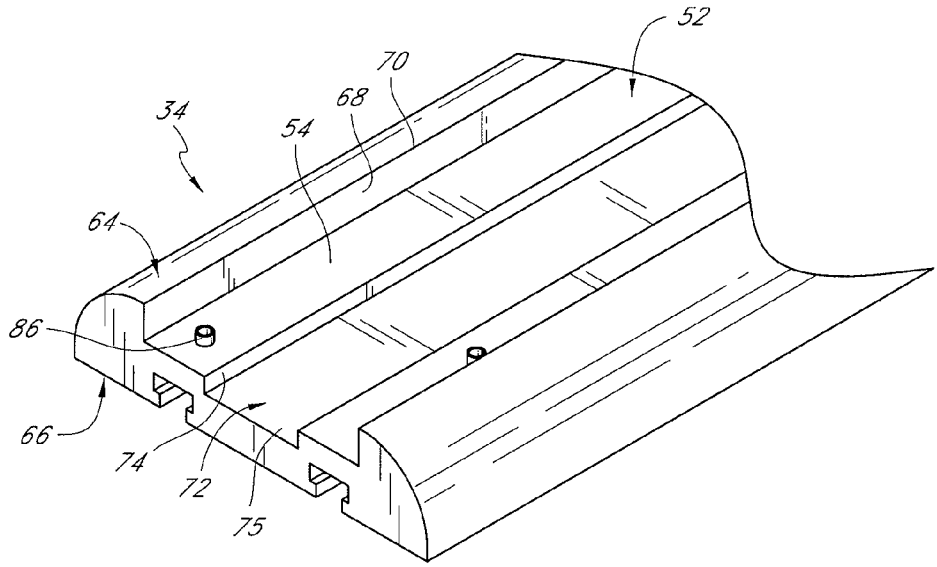
FIG. 3 is a perspective view of a substrate portion of the embodiment of FIG. 1.
Figure 4:
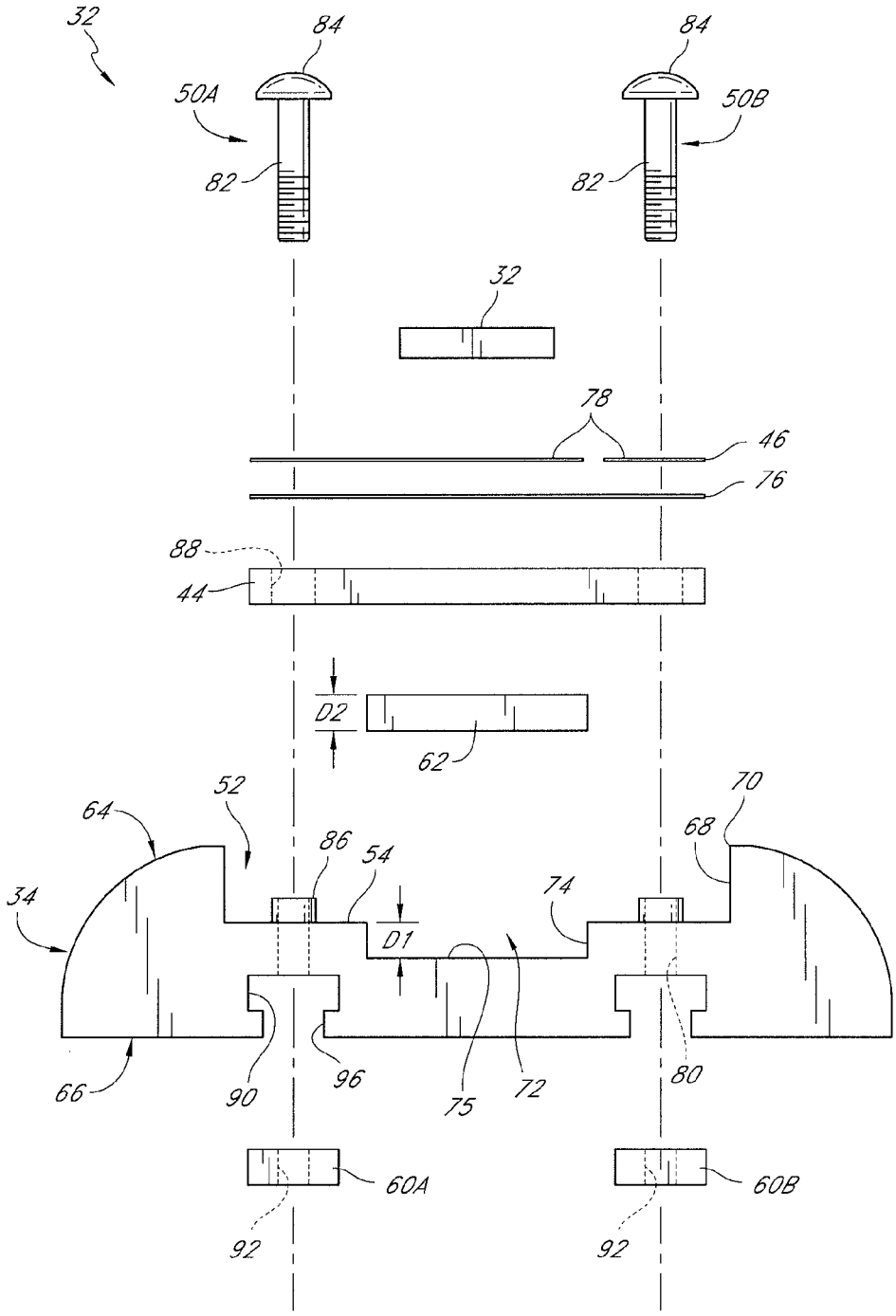
FIG. 4 is an exploded view of the cross-section of FIG. 2, showing additional detail.
Figure 5:
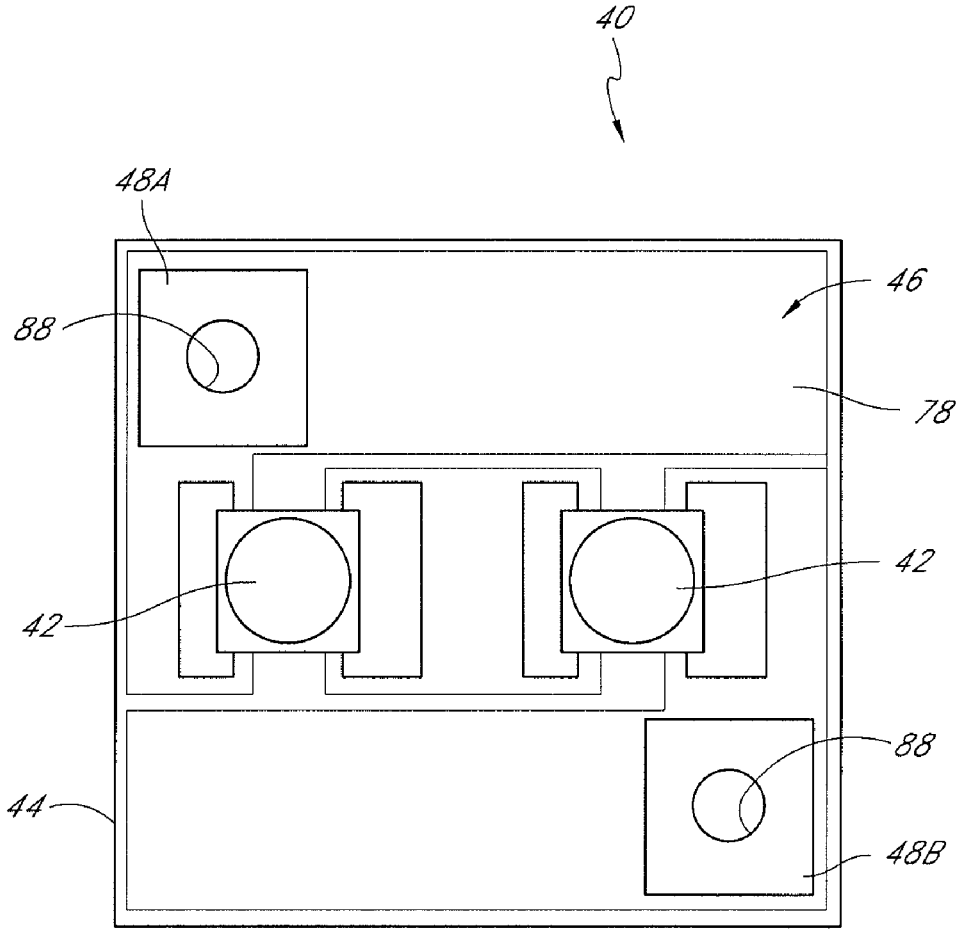
FIG. 5 is a plan view of one embodiment of an LED module.

As best shown in FIGS. 2-4, the illustrated substrate 34 comprises a module mounting cavity 52 having a module mount surface 54 upon which the modules 40 are placed. An elongate positive rail 60A and an elongate negative rail 60B are also supported by the substrate 34. The positive and negative rails 60A, 60B are spaced apart from each other and from the module mount surface 54. Preferably, the rails 60 are elongate and electrically conductive. In the illustrated embodiment, each module 40 is arranged on the module mount surface 54 and the positive and negative module bolts 50 are advanced through the substrate 34 into contact with the corresponding rail 56. Thus, the bolts 50 secure the LED modules 40 in place on the substrate 34, connect electrically to the rails 60, and connect electrically to the positive and negative contacts 48A, 48B. Preferably, the rails 60 are energized so that electric current will flow from one rail 60 through a bolt 50 to the module 40, through the circuit 46 on the module to the opposing bolt 50, and further to the opposing rail 60. In this manner, multiple LED modules 40 are attached to the substrate 34 and rails 60 in an electrically parallel fashion.

In the present specification the term "rail" is a broad term used in accordance with its ordinary meaning, and also including an elongate member of any cross-sectional shape to which other devices or members may be connected, be it by a bolt 50 as in the embodiment discussed above or by clip, solder, or some other type of structure or method. Additionally, a rail may in some embodiments or may not in others be configured to provide structural support, such as to support a threaded fastener.

Continuing with specific reference to FIGS. 1, 2 and 4, an elongate heat spreader strip 62 preferably is supported by the substrate 34 and is arranged so that the body 44 of each LED module 40 directly contacts the heat spreader 62. Heat generated by the LEDs 42 is communicated to the body 44 of the module 40. From the body 44 the heat is communicated at least to the heat spreading strip 62, which acts as a heat sink, and which also helps communicate heat to the environment. Thus, heat generated by the LEDs 42 is drawn away from the LEDs in order to keep the LEDs from becoming excessively hot during extended use.

With particular reference to FIGS. 1-4, the illustrated substrate 34 has a front side 64 and a back side 66. Preferably, the module mounting cavity 52 is formed in the front side 64. The module mounting cavity 52 preferably is defined by a cavity wall 68 and the module mount surface 54. The cavity wall 68 intersects with the front side 64 at a front edge 70 of the cavity wall 68. Preferably, LED modules 40 are mounted within the cavity 52 so that the modules, including the LED light sources 42, do not extend outwardly beyond the front edges 20 of the opposing cavity walls 68. As such, the substrate 34 blocks bright point light sources, as well as other components within the cavity 52, from view when the illumination strip 32 is viewed from a side direction.

Preferably, the substrate 34 is electrically non-conductive. In a preferred embodiment, the substrate is made of a plastic such as Delrin™ or the like. Preferably, the substrate is a dielectric rated for use up to about 90° C.

A heat-spreader cavity 72 is formed in the cavity mounting surface 54. The heat spreader cavity 72 is defined by a cavity wall 74 that extends into the substrate 34 and terminates in a base surface 75. The elongate heat spreader 62 is adapted to fit within the heat spreader cavity 72. As shown, the heat spreader 62 has a generally rectangular cross-section that generally corresponds to the cross-sectional shape of the heat spreader cavity 72. In one embodiment, the depth D1 of the heat spreader cavity 72 is less than a thickness D2 of the heat spreader member 62. As such, even though the heat spreader 62 generally fits within the cavity 72, since D1<D2 the heat spreader 62 protrudes from the module mount surface 74 a short distance such as, for example, about $^{1}/_{1000}$ inch. With such a configuration, when an LED module 40 is mounted on the mounting surface 54, direct and secure contact is established between the heat spreader 62 and the body 44 of the module 40 despite minor variations that may be expected in the substrate 34. Such direct contact facilitates heat transfer from the LED module 40 to the heat spreader 62. Preferably, the heat spreader 62 comprises an elongate metal strip, such as aluminum, having advantageous heat transfer properties. Of course, other materials having advantageous heat transfer properties can be used. Also, in other embodiments portions of the heat spreader may be ribbed or otherwise shaped and/or treated to enhance heat transfer to the environment.

As mentioned above and with additional reference to FIG. 5, the LED module 40 preferably comprises the body 44 that is made of a heat conductive material such as aluminum. The electric circuit 46 is supported by the body 44, and preferably is electrically insulated relative to the body by a dielectric layer 76. The electric circuit 46 preferably comprises contacts 78, such as copper contacts. The dielectric and contact layers 76, 78 are specifically illustrated in FIG. 4, but it is to be understood that they are not necessarily shown to scale, and the dielectric and contact layers 76, 78 preferably are very thin, such as on the order of 1 to 2 mils in thickness each. The one or more LEDs 42 are attached to the circuit 46, which is supported by the body 44. In a preferred embodiment the LEDs 42 are provided in a prepackaged form that facilitates easy assembly of the module 40.

Preferably, LED modules 40 are arranged on the substrate 34 at predetermined, spread-apart intervals. In one embodiment, LED modules are arranged on six inch centers. In another embodiment, LED modules are arranged on three inch centers. Preferably, holes 80 are provided through the substrate 34 to accommodate mount bolts 50 at the appropriate mounting locations. Preferably, the bolts 50 have an elongate shank 82 and a head portion 84. The head portions 84, when tightened, engage the associated positive or negative contact 48 of the circuit 46 on the LED module 40. As such, the bolts 50A, 50B are electrically polarized, and current flows through the bolts 50A, 50B to the LEDs 42 on the modules 40.

As best shown in FIGS. 3 and 4, a raised portion 86 of the illustrated substrate 34 surrounds each module bolt hole 80 at the module mount surface 54. Preferably, the raised portions 86 are positioned on the substrate 34 so as to generally correspond to apertures 88 formed through the LED module body 44 and through which the bolts 50 extend. In the illustrated embodiment, the raised portions 86 extend upwardly from the mount surface 54 a distance up to or less than the thickness of the module body 44; however, preferably the raised portions 86 extend upwardly enough to act as a guide and insulator for the bolts 50 relative to the module body 44. Accordingly, there is no metal-to-metal contact of the bolts 50 with the module body 44, and thus short-circuits are avoided. In other embodiments, a plastic washer, spacer, or the like can be employed instead of the raised portion being formed integrally with or bonded to the substrate.

During manufacture, the substrate 34 preferably is extruded, and then portions are machined, if desired, to provide the shapes illustrated. It is to be understood that other manufacturing processes, such as injection molding, may also be used.

With continued specific reference to FIGS. 1-4, preferably the substrate 34 has a pair of elongate rail cavities 90 provided therein in which the electrically conductive elongate rails 60 are disposed. The rails 60 preferably are metal rails adapted to conduct electricity. As indicated above, during use the rails 60A, 60B are energized so that there is a voltage difference between them. As shown, preferably the LED module mount bolts 50A, 50B engage the rails through corresponding bolt mount holes 80. As such, electric current from one rail 60A flows through the bolts 50A, 50B to the LEDs 42 on the module 40 and to the opposing rail 60B. The rails 60 thus supply electric current across LED modules 40, and a plurality of such LED modules 40 may be arranged electrically in parallel when the bolts 50 are connected the rails 60.

In the illustrated embodiment, the elongate rails 60 are formed of an electrically conductive material that is also heat conductive. The illustrated rails comprise aluminum. Additionally, in the illustrated embodiment, the rails 60 have a substantially rectangular cross-sectional profile. This profile is advantageous for multiple reasons. For example, the profile makes it simple to create bolt holes 92 that threadingly engage the LED mounting bolts 50. Additionally, the rails 60 preferably have sufficient thickness to provide a secure mounting connection via the bolt holes 92. The mass of the rails 60 is also advantageously chosen to assist in evacuating heat from attached LED modules 40. More specifically, a portion of the heat generated by the LEDs 42 is communicated through the bolts 50 to the rails 60. The rails function as a heat sink, dispersing the heat through the mass of the rails and also diffusing heat to the environment.

With continued reference to FIGS. 1-4, the rails 60 sit within the rail cavities 90 formed in the substrate 34. However, access cavities 96 are also aligned with the rail cavities 92 so that a portion of each rail 60 is exposed through the back 66 of the substrate 34. This assists in heat transfer, but also assists in joining multiple strip sections 32 to form an illumination system comprising multiple strip sections.

Figure 6:
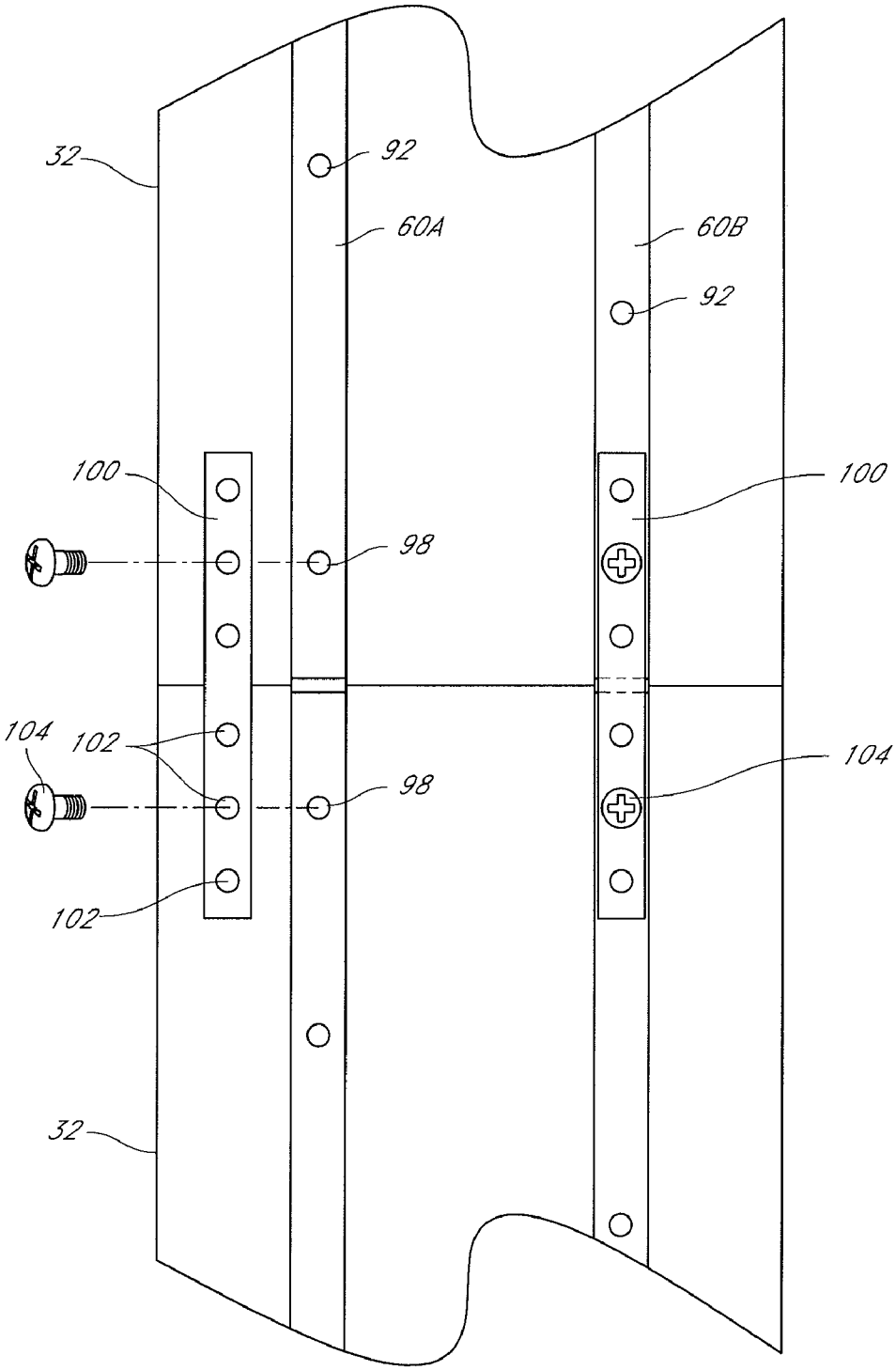
FIG. 6 is a back-side view of an embodiment in which two illumination strips are fit together end-to-end.

With reference next to FIG. 6, a back side view of two abutting strip sections 32 is shown. As illustrated, the ends of the strip sections 32 are aligned with and adjacent one another. The rails 60 are visible and accessible through the rail access cavities 96. As shown, module bolt mount holes 92 extend through the rails 60. These module bolt holes 92 are already being used by LED module mount bolts 50. However, additional holes 98 are formed through the rails 60 adjacent the end of each lighting strip 32. Conductive jumpers 100 are provided for attaching to the rails 60 of adjacent strip sections 32 at these holes 98. Each jumper 100 preferably comprises an electrically conductive material, such as aluminum, having a width sized to fit within the access cavity 96 of the adjacent substrates 34 so as to engage the rails 60. A plurality of spaced-apart mount holes 102 are provided on each jumper 100 to provide some versatility in aligning with jumper mount holes 98 formed in the rails 60. As illustrated, to connect strip sections 32 end-to-end an elongate jumper 100 is aligned with desired jumper mount holes 98 of adjacent strip sections 32, and jumper bolts 102 are extended through the holes 102 to threadingly engage the jumper mount hole 98 of the corresponding rail 60 in order to secure the jumper 100 in place. Preferably, the access cavity 96 is of sufficient depth so that the jumper 100 and jumper bolts 104 do not extend outwardly beyond the back surface 66 of the substrate 34. Thus, even with the jumpers 100 bolted in place, the adjoined strip sections 32 will fit flush against an installation surface such as the undersurface of a cabinet.

With the jumpers 100 in place, the adjacent strip sections 32 are joined end-to-end both mechanically and electrically. As such, if the rails 60 of one of the strip sections 32 are energized, such electrical energy is communicated to both strip sections. Further, such an electrical and mechanical connection can be used to connect several strip sections 32. Still further, although the illustrated embodiment illustrates strip sections joined end-to-end, it is to be understood that strip sections can be joined at various angles, such as 90°, 45°, or the like, by using jumpers having curving or bending shapes and dimensions to accommodate such varying angular relationships between adjacent strip sections. Also, the strip sections can be cut as desired to fit a given situation or installation configuration.

Figure 7:
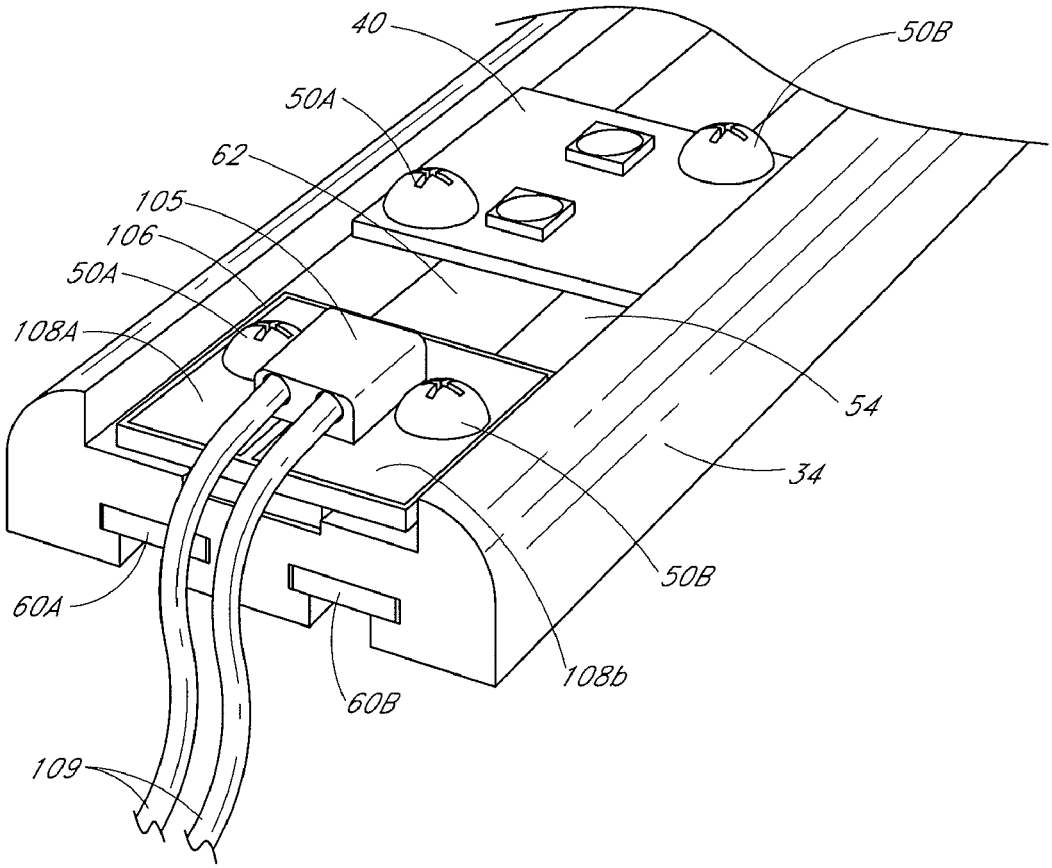
FIG. 7 is a perspective view of another embodiment for electrically joining strips together.

It is to be understood that other structures and methods can be employed for joining adjacent strip sections 32 electrically to one another. For example, FIG. 7 illustrates an embodiment in which a wire connector 105, such as the two-position poke-in connector available from Tyco (part number 1954097-1), is connected to a circuit board 106 having a positive contact 108A and a negative contact 108A. The circuit board 106 is mounted on the mount surface 54 and, in a preferred embodiment, positive and negative bolts 50A, 50B extend through corresponding holes in the circuit board 106 to engage and electrically connect the rails 60A, 60B to the positive and negative contacts 108, 108*b* of the circuit board 106. Wires 109 extend from the wire connector 105 to a wire connector mounted on an adjacent strip section. As such, adjacent strip sections 32 are electrically connected to one another, but are not rigidly mechanically connected to one another, thus providing further versatility in installation. Additionally, a wire connector 105 as in this embodiment can advantageously attach to a power source to supply power to a strip illumination device 30 comprising one or more electrically-connected strip sections 32.

Mounting a single or a plurality of the strip sections 100 to an installation surface, such as the undersurface of kitchen cabinets, can be achieved in any of several ways. For example, in one embodiment, holes are provided through the center of the substrate, and even through the heat spreader. A screw, bolt, or the like can be extended through such holes and into the installation surface to hold the strip section in place. A plurality of such connections may advantageously be provided. In another embodiment, an adhesive may be applied to the back surface of the substrate in order to install the strip sections. In still another embodiment, screws or the like may be advanced through the substrate. Other methods and apparatus, such as clips, can also be employed for installing the strip sections.

As discussed above, the heat spreading metal strip 62 advantageously helps to evacuate heat generated by the LEDs 42. As such, in the illustrated embodiment, the heat spreader 62 is arranged so as to contact the LED module body 44 at a location directly beneath the LED 42. This places the heat spreader 62 in an ideal position to evacuate heat generated by the LED 42. Such heat generated by the LED 42 flows first to the portion of the body 44 directly below the LED and is then radiated through the body 44 and to the heat spreader 62. In its position directly below the LEDs, the heat spreader is in an ideal position to receive such heat without necessitating such heat being communicated further along the body. Thus, more efficient and direct heat transfer is provided between the LEDs and the heat spreader.

Figure 8:
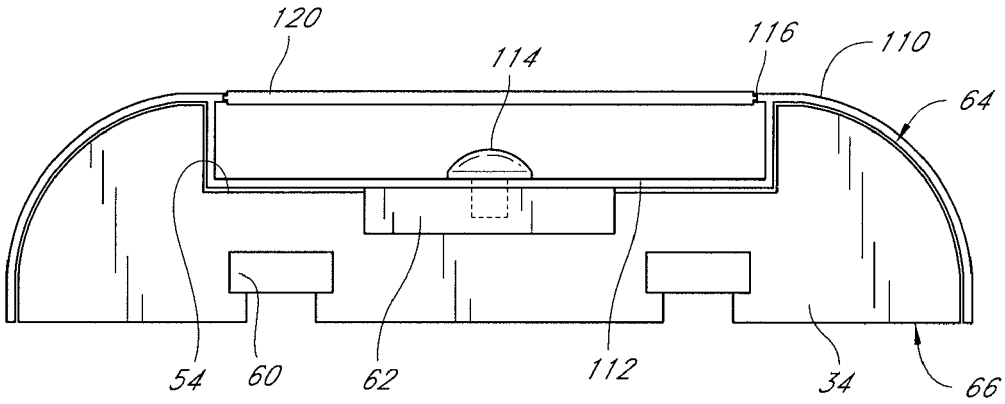
FIG. 8 is a cross-sectional view of an embodiment of an illumination strip having a housing fit thereon, but not showing any LED modules that may be mounted thereon.

With reference next to FIG. 8, another embodiment is provided in which a housing/shroud 110 is arranged over the substrate 32. FIG. 8 shows a cross-sectional view taken through an embodiment of the strip section at a location of the strip section between LED modules. Thus, LED modules are not shown in the drawing. In the illustrated embodiment, an elongate heat conductive shroud 110 is disposed over the substrate 32. Preferably, the shroud 110 fits generally complimentarily over the front face 64 of the substrate 34, including the cavity wall 68 and module mount surface 54. In one embodiment, apertures (not shown) are formed through a base portion 112 of the shroud 110 in order to accommodate and avoid interference with LED modules.

Preferably, the shroud 110 is attached, such as with a bolt 114, to at least the heat spreader member 62 so as to encourage metal-to-metal contact between the shroud 110 and the heat spreader 62, thus maximizing the transfer of heat from the heat spreader 62 to the shroud 110 so that such heat can be communicated to the environment. Preferably, the shroud 110 includes cover mounts 116 to which a cover 120 can be releasably mounted, preferably extending across the module mounting cavity 52. The cover 120 preferably comprises a plastic and/or glass member adapted to communicate light from the LEDs 42 therethrough. The cover 120 also may include optical elements and/or may function as a light diffuser. Further, the cover can function to protect the LED modules within the cavity of the substrate.

In the illustrated embodiment, the LED modules 40 each comprise two LEDs, 42 which have a combined voltage requirement of about 7.4 volts. Correspondingly, a power supply is provided that is adapted to output a power of 7.4 volts. As such, the power supply is well matched to the LED module power requirements. Thus, there is little or no requirement for resistors or other electrical componentry to further modify the power provided to each module. Accordingly, efficiency of the LED modules is increased as losses to other componentry is avoided. Although the illustrated embodiment employs a power supply adapted to provide 7.4 volts, it is to be understood that, in other embodiments, different arrangements of LEDs of various sizes and colors can necessitate differing power requirements. For such embodiments, the power supply preferably is matched to the voltage requirement of the illumination device. It is also to be understood that other embodiments may employ power conditioning componentry on the module circuit so as to modify and maximize the efficiency of power delivery to the LEDs.

With reference again to FIGS. 6 and 7, strip sections 32 can be joined end-to-end by, for example, jumpers 100 or a wire connector 105/circuit board 106, attached to jumper mount bolt holes 98 provided in the rails 60 adjacent ends of the strip section 32. In another embodiment, jumper mount bolt holes 98 are provided at a plurality of spaced-apart locations along the length of the strip section 32 and not just adjacent the ends. The substrate and/or rails preferably are marked adjacent such jumper mount holes. The markings correspond to suggested cut points at which an installer may advantageously cut the strip section in order to custom-fit the illumination device for a particular installation. The extra jumper mount holes 98 ease the installer's job by providing cut points for several standardized lengths of the strip section, even though strip sections may be supplied only in a limited number of specified lengths. Such marked strip sections with pre-made jumper mark and holes are easily customized in the field using a simple hack saw or the like.

As discussed above, in embodiments employing LED modules having an aluminum body, since the bolts 50 are electrically charged and extend through an aperture through the aluminum module body, it is important that the bolts do not engage the body 44, which would short out the circuit 46. Additionally, Applicants have noted that in this type of embodiment, if a bolt using a standard 3/16" bolt head is tightened excessively, damage may be caused to the module contacts, deforming the contacts 48 and possibly the dielectric 76, thus possibly creating a short circuit in which the bolt 50 and/or copper from the contacts makes contact with the aluminum body.

In the illustrated embodiment, the LED modules are secured in place using number 440×3/8 inch long bolts. Such bolts have a head diameter of about 0.250 inches, which is far greater than typically used in such applications. Applicants have discovered that when employing a bolt having such a broad head, forces exerted on the contact and dielectric layers 78, 76 from tightening the bolt are distributed so that the thin contact and dielectric layers 78, 76 are substantially undamaged upon tightening of the bolt 50. This configuration has been determined to work effectively when the combined thickness of the dielectric and copper trace layers 78, 76 is between about 2-3 mils (0.002-0.003 inch). Since a preferred bolt head 84 size is about 0.250 inches, in order to have sufficient distribution for bolt tightening forces with such thin layers of dielectric and traces, it is anticipated that an advantageous ratio of the bolt head width, or the bolt head diameter, to the overall thickness of the dielectric and copper trace layers is between about 80-125 to 1 (80:1-125:1). Applicants have demonstrated that using bolts within such parameters provides acceptable electrical and structural connection without causing damage to the thin dielectric and/or copper contact layers when tightened in the range of about 25-35 in-lb.

Since LEDs operate on a direct current, the direction of the current is important for proper operation of the LEDs. For example, if the LEDs are arranged in the circuit with the current flowing in the incorrect direction, the LEDs will not light. Thus, it is important that the LED modules are connected in the correct alignment. In accordance with another embodiment, a mechanical structure is provided for insuring correct polarity, or correct directional installation, of each LED module. In one embodiment, a third aperture is formed through the module. Correspondingly, a third raised portion of the substrate is provided extending upwardly from the mount surface in the cavity of the substrate. When LED modules are placed in the correct polarity position to align the mount holes, the third hole will engage and align with the raised portion of the substrate. However, if the modules are arranged in an incorrect polarity, even though the bolt apertures may align, the raised portion of the substrate will engage the bottom surface of the LED module, preventing mounting of the module.

It is to be understood that other structures may be employed to ensure that the LED module is not mounted in a reverse-polarity direction. For example, in another embodiment, an LED module is configured so that the holes 88 are not placed symmetrically in the body 44. As such, when the holes 88 are aligned with the corresponding holes 80 in the substrate, it can be visually determined that the LED module is incorrectly mounted and/or a portion of the body 44 will interfere with a portion of the substrate to prevent reverse-polarity mounting of the module.

Figure 9:
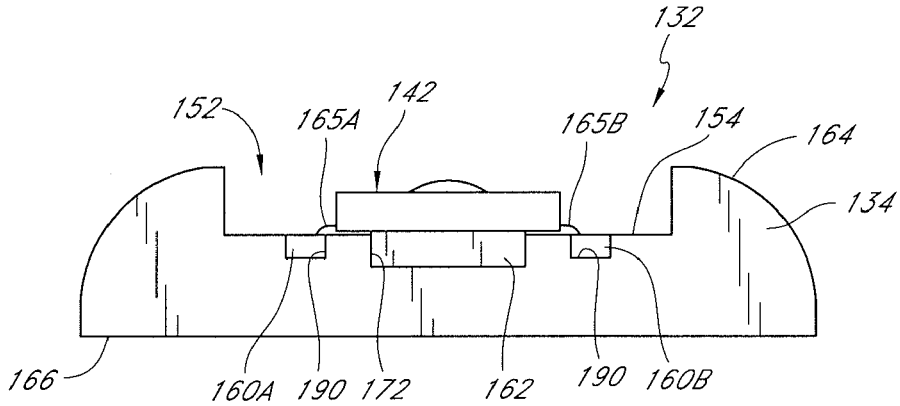
FIG. 9 is a sectional view of another embodiment of an illumination strip.

With reference next to FIG. 9, another embodiment of a lighting strip section 132 is depicted in cross-section. This embodiment has an elongate substrate 34 having front 164 and back 166 sides. A light source mounting cavity 152 is formed in the front side, and includes a mount surface 154. The plurality of LEDs 142 preferably are mounted spaced apart upon the mount surface 154. Preferably, an elongate heat spreader 162 is disposed within a heat spreader cavity 172 as formed into the mount surface 154. As illustrated, preferably the LEDs 142 rest upon the heat spreader 162 so that heat generated by the LED is communicated easily to the heat spreader 162.

Elongate rail cavities 190 are formed in the mount surface 154 of the substrate 134 on either side of the heat spreader cavity 172. Preferably, positive and negative rails 160A, 160B are fit into the rail cavities 190. As with the rails 60 discussed above, the rails 160A, 160B preferably are oppositely energized. However, as illustrated, the rails 160A, 160B in the preferred embodiment are accessible at the mount surface 154.

In the embodiment illustrated in FIG. 9, the LED 142 comprises a pre-packaged LED having positive and negative leads 165A, 165B. Preferably, the positive lead 165A is attached to the positive rail 160A and the negative lead 165B is attached to the negative rail 160B. As such, the LED 142 is energized. Further, preferably the LED package 142 includes a heat sink, and the heat sink of the package is in close contact with the heat spreader 162 so as to even further facilitate evacuation of heat from the diode of the LED package to the heat spreader 162 and to the environment. In another embodiment, the heat sink of the package is in substantially direct contact with the heat spreader. In the illustrated construction, the embodiment of FIG. 9 enables direct mounting of a LED package onto a light strip section.

Figure 10:
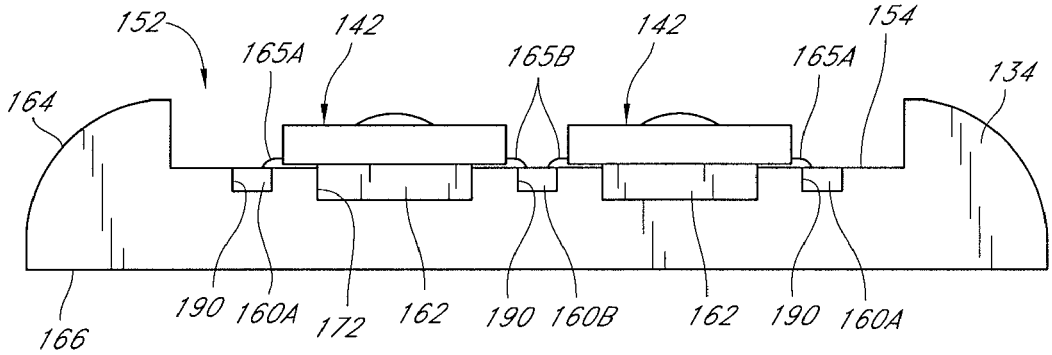
FIG. 10 is a sectional view of yet another embodiment of an illumination strip.

With reference next to FIG. 10, another embodiment is illustrated comprising an elongate substrate 134 having front and back sides 164, 166 and a mounting cavity 152 formed through the front side 164. A mount surface 154 is disposed in the mount cavity 152. A pair of elongate heat spreader cavities 172 are formed in the mount surface 154 and three elongate rail cavities 190 are formed in the mount surface 154. In the illustrated configuration, positive rails 160A are disposed outwardly of the heat spreaders 162, and a negative rail 160B is disposed between the heat spreaders 162. Preferably, elongate heat spreaders 162 are disposed in the heat spreader cavities 174 and elongate rails 160A, 160B are disposed in the elongate rail cavities 190.

Continuing with reference to FIG. 10, a plurality of pre-packaged LEDs 142 are provided, each having positive and negative leads 165A, 165B. As illustrated, positive leads 165A of the LEDs 142 are mounted onto one or the other of the two positive rails 160A. However, the negative leads 165B are all electrically attached to the same negative rail 160B. Although the LEDs 142 are shown in FIG. 10 as being immediately adjacent one another, it is to be understood that LEDs can be mounted so as to be linearly staggered relative to one another.

In a preferred embodiment, both positive rails 160A are simultaneously energized. However, in another embodiment, the positive rails can be energized independently, thus selectively lighting the LEDs attached thereto. Further, in other embodiments, multiple colors of LEDs can be employed, and selective actuation of the positive rails can alter both the brightness and color hue of the illumination device. Still further, one or more dimming circuits can be employed to even further control brightness and color hue.

The embodiments discussed above have illustrated certain inventive principles by showing specific embodiments. As noted, other structures may apply such principles in other ways. For example, in another embodiment, rails may be exposed so that an LED module can connect to the rails by clip fasteners rather than bolts, and the clips may communicate electricity to the circuit on the module. In another embodiment, the module may clip onto a substrate that supports the rails, and a contact portion of the LED module may engage so as to energize the LEDs. Accordingly, it is envisioned that fasteners, substrates, rails, LED modules, and parts incident thereto may have configurations and properties that differ substantially from this disclosure.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above.

What is claimed is:

1. An illumination apparatus, comprising:

an elongate substrate;

first and second electrically conductive rails, the first and second rails supported by the substrate so that the first and second rails are spaced apart and electrically insulated from one another;

a plurality of LED modules, each module comprising a module body, an LED, and an electrical current path configured so that electrical current flows from a first electrical contact to a second electrical contact, the LED being interposed in the current path between the first and second contacts so that electrical current flows along the path and through the LED; and a plurality of pairs of fasteners adapted so that each of the plurality of LED modules is connected by a pair of fasteners to the elongate substrate so that the first and second contacts of each LED module are electrically connected to the first and second rails, respectively;

wherein a first one of each pair of fasteners is adapted to engage the first rail and the first contact so as to conduct current between the first rail and the first contact.

2. An illumination apparatus as in claim 1, wherein a second one of each pair of fasteners is adapted to engage the second rail and the second contact so as to conduct current between the second rail and the second contact.

3. An illumination apparatus as in claim 1, wherein the first fastener comprises a threaded fastener, the first rail comprises a threaded portion, and the first fastener threadingly engages the first rail threaded portion.

4. An illumination apparatus as in claim 3, wherein a heat conductive insert is supported by the elongate substrate so that the LED module body generally directly contacts the insert.

5. An illumination apparatus as in claim 3, wherein the LED module comprises a dielectric layer having a dielectric thickness, the dielectric layer disposed on a first side of the LED module body, the first and second contacts disposed on the dielectric layer and having a contact thickness, and wherein a first aperture is formed through the body, dielectric layer and first contact, the first aperture configured to accommodate a shank portion of the first fastener extending therethrough, and wherein the first fastener has a head portion adapted to engage the first contact, a ratio of a diameter of the head portion to the combined dielectric thickness and contact thickness being between about 80:1-125:1.

6. An illumination apparatus as in claim 1, wherein the first and second rails are substantially embedded in the elongate substrate.

7. An illumination apparatus, comprising:

an elongate substrate;

first and second electrically conductive rails, the first and second rails supported by the substrate so that the first and second rails are spaced apart and electrically insulated from one another;

a plurality of LED modules, each module comprising a module body, an LED, and an electrical current path configured so that electrical current flows from a first electrical contact to a second electrical contact, the LED being interposed in the current path between the first and second contacts so that electrical current flows along the path and through the LED; and a plurality of fasteners adapted to connect the plurality of LED modules to the elongate substrate so that the first and second contacts of each LED module are electrically connected to the first and second rails, respectively;

wherein a heat conductive insert is supported by the elongate substrate so that the LED module body generally directly contacts the insert.

8. An illumination apparatus as in claim 7, wherein the heat conductive insert has an insert thickness, and the elongate substrate comprises a substrate cavity configured to generally accommodate the heat conductive insert, the substrate cavity having a cavity depth, and wherein the cavity depth is less than the insert thickness.

9. An illumination apparatus as in claim 7, wherein an elongate cavity is formed in the substrate, and the heat conductive insert is elongate and sits at least partially in the elongate cavity.

10. An illumination apparatus as in claim 9, wherein each LED module body has opposing first and second sides, and the LED is disposed adjacent a mounting point on the first side of the body, and wherein the body is connected to the heat conductive insert so that the insert directly contacts the second side of the body directly opposite the mounting point.

11. An illumination apparatus as in claim 7 additionally comprising a shroud covering at least a portion of the substrate, wherein the shroud comprises a heat conductive material, and the shroud is directly connected to the heat conductive insert so that heat flows from the insert to the shroud.

12. An illumination apparatus as in claim 11, wherein the shroud is configured to support an optical member.

13. An illumination apparatus, comprising:

an elongate substrate;

first and second electrically conductive rails, the first and second rails supported by the substrate so that the first and second rails are spaced apart and electrically insulated from one another;

an elongate heat sink supported by the substrate generally between the first and second rails; and a plurality of pre-packaged LEDs;

wherein the LEDs are electrically connected to the first and second rails so that an electric current path is established between the rails and across at least one of the LEDs, and the LEDs are mounted so that the associated LED package is substantially directly aligned with the heat sink.

14. An illumination apparatus as in claim 13, wherein the LED package is vertically aligned with the heat sink.

15. An illumination apparatus as in claim 14, wherein the heat sink is horizontally spaced from the rails.

16. An illumination apparatus as in claim 14, wherein the heat sink is vertically spaced from the rails.

17. An illumination apparatus as in claim 14, wherein the LED package comprises a package heat sink, and the package heat sink is in substantially direct contact with the heat sink.

18. An illumination apparatus as in claim 13 additionally comprising a plurality of lighting modules, each of the lighting modules comprising a circuit board having at least one of the plurality of LEDs mounted thereon, wherein the plurality of lighting modules are mounted on the substrate so that each module engages the heat sink, and wherein the heat sink simultaneously engages a plurality of the lighting modules.

* * * * *